US009922636B2

(12) United States Patent
Ku

(10) Patent No.: US 9,922,636 B2
(45) Date of Patent: Mar. 20, 2018

(54) MITIGATION OF UNSTABLE CONDITIONS IN AN ACTIVE NOISE CONTROL SYSTEM

(71) Applicant: Bose Corporation, Framingham, MA (US)

(72) Inventor: Emery M. Ku, Somerville, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/186,842

(22) Filed: Jun. 20, 2016

(65) Prior Publication Data

US 2017/0365245 A1 Dec. 21, 2017

(51) Int. Cl.

| | |
|---|---|
| ***G10K 11/16*** | (2006.01) |
| ***G10K 11/178*** | (2006.01) |
| ***H04R 1/10*** | (2006.01) |

(52) U.S. Cl.

CPC ..... *G10K 11/178* (2013.01); *H04R 1/1083* (2013.01); *G10K 2210/3025* (2013.01); *G10K 2210/3027* (2013.01); *G10K 2210/3028* (2013.01); *H04R 2460/01* (2013.01)

(58) Field of Classification Search

CPC ..... G10K 11/178; G10K 2210/3025; G10K 2210/3027; G10K 2210/3028; H04R 2460/01; H04R 1/1083

USPC ..... 381/71.1, 71.2, 71.8, 71.6, 71.11, 71.12, 381/94.1, 95, 96, 122

See application file for complete search history.

(56) References Cited

U.S. PATENT DOCUMENTS 6,118,878 A 9/2000 Jones
8,798,283 B2 * 8/2014 Gauger, Jr. ..... H04R 3/002 381/71.6
2010/0135483 A1 6/2010 Mohammad et al.
2012/0057720 A1 * 3/2012 Van Leest ..... G10K 11/1782 381/71.11
2016/0125866 A1 * 5/2016 Park ..... G10K 11/178 381/71.11
2017/0110106 A1 * 4/2017 Kumar ..... G10K 11/1788

FOREIGN PATENT DOCUMENTS

EP 0 814 456 12/1997

OTHER PUBLICATIONS

Van Waterschoot; "Design and Evaluation of Digital Signal Processing Algorithms for Acoustic Feedback and Echo Cancellation"; Katholieke Universiteit Leuven; 445 pp; 2009.

International Search Report and Written Opinion; PCT/US2017/038322; dated Sep. 22, 2017; 13 pages.

* cited by examiner

*Primary Examiner* — Vivian Chin
*Assistant Examiner* — Friedrich W Fahnert
(74) *Attorney, Agent, or Firm* — Fish & Richardson P.C.

(57) ABSTRACT

The technology described in this document can be embodied in a computer-implemented method that includes receiving a portion of a feedback signal of an active noise control (ANC) system, and processing the portion of the feedback signal using an adaptive line enhancer (ALE) filter to detect a tonal signature. The method also includes determining, by one or more processing devices, that the tonal signature represents an unstable condition, and responsive to determining that the tonal signature represents an unstable condition, generating one or more control signals for adjusting one or more parameters of the ANC system, to mitigate the unstable condition.

24 Claims, 8 Drawing Sheets

MITIGATION OF UNSTABLE CONDITIONS IN AN ACTIVE NOISE CONTROL SYSTEM

TECHNICAL FIELD

This disclosure generally relates to active noise control (ANC) systems, such as ANC systems deployed in headphones.

BACKGROUND

Active noise control involves cancelling unwanted noise by generating a substantially opposite signal often referred to as anti-noise.

SUMMARY

In one aspect, this document describes a computer-implemented method that includes receiving a portion of a feedback signal of an active noise control (ANC) system, and processing the portion of the feedback signal using an adaptive line enhancer (ALE) filter to detect a tonal signature. The method also includes determining, by one or more processing devices, that the tonal signature represents an unstable condition, and responsive to determining that the tonal signature represents an unstable condition, generating one or more control signals for adjusting one or more parameters of the ANC system, to mitigate the unstable condition.

In another aspect, this document describes an active noise control (ANC) system that includes an error sensor configured to provide a feedback signal, and an instability detector. The instability detector includes an adaptive line enhancer (ALE) filter configured to process at least a portion of the feedback signal to detect a tonal signature, and a detection engine comprising one or more processing devices. The detection engine is configured to determine that the tonal signature represents an unstable condition, and responsive to determining that the tonal signature represents an unstable condition, generate one or more control signals for adjusting one or more parameters of the ANC system, to mitigate the unstable condition.

In another aspect, this document describes a machine-readable storage device having encoded thereon computer readable instructions for causing one or more processors to perform various operations. The operations include receiving a portion of a feedback signal of an active noise control (ANC) system, and processing the portion of the feedback signal using an adaptive line enhancer (ALE) filter to detect a tonal signature. The operations also include determining that the tonal signature represents an unstable condition, and responsive to determining that the tonal signature represents an unstable condition, generating one or more control signals for adjusting one or more parameters of the ANC system, to mitigate the unstable condition.

Implementations of the above aspects can include one or more of the following features.

The feedback signal can be obtained using an error sensor of the ANC system. The feedback signal can be processed by a digital bandpass filter to generate the portion of the feedback signal processed by the ALE filter. The ALE filter can be implemented as a single-tap infinite impulse response (IIR) filter. Determining that the tonal signature represents an unstable condition can include determining that the tonal signature includes components within a predetermined frequency range. The predetermined frequency range can be substantially between 1.5 KHz and 5 KHz or between 500 Hz and 2 KHz. A quantity indicative of a relative strength of the tonal signature in an output of an acoustic transducer of the ANC system can be computed, and a determination may be made that the tonal signature represents an unstable condition based on the quantity satisfying a threshold condition. Computing the quantity can include receiving a measure of residual error from the ALE filter, receiving a portion of a signal-of-interest to be output by the acoustic transducer, and computing the quantity as a ratio of a first quantity and a second quantity. The first quantity can be indicative of the energy of the tonal signature, and the second quantity can be indicative of the energy of a combination of the residual error and the portion of the signal-of-interest. The second quantity can also be indicative of the energy of a portion of a signal captured by a feedforward microphone of the ANC system. The one or more parameters being adjusted to mitigate the unstable condition can include at least one of: a gain associated with a filter applied to a feedback microphone of the ANC system, and a gain associated with a filter applied to a feedforward microphone of the ANC system. The ANC system can be deployed in a noise-reducing headphone. The one or more control signals can be configured to adjust one or more coefficients of an adaptive filter of the ANC system to compensate for changes to a transfer function of a secondary path of the ANC system.

Various implementations described herein may provide one or more of the following advantages. A low-complexity adaptive filter such as an adaptive line enhancer (ALE) may be used to quickly detect the presence of unstable condition in an active noise control (ANC) system without having to use expensive hardware. Responsive to such determination, the unstable condition can be mitigated early in the process. In some cases where the ANC system is deployed in noise cancelling headphones or earphones, such early mitigation may prevent the headphone or earphones from producing loud sounds that may be uncomfortable to the user. In some cases, the ability to detect and respond to unstable conditions may allow for design of more aggressive feedback or feedforward compensators that operate over a wider range of frequencies than would be otherwise possible.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

Figure 1:
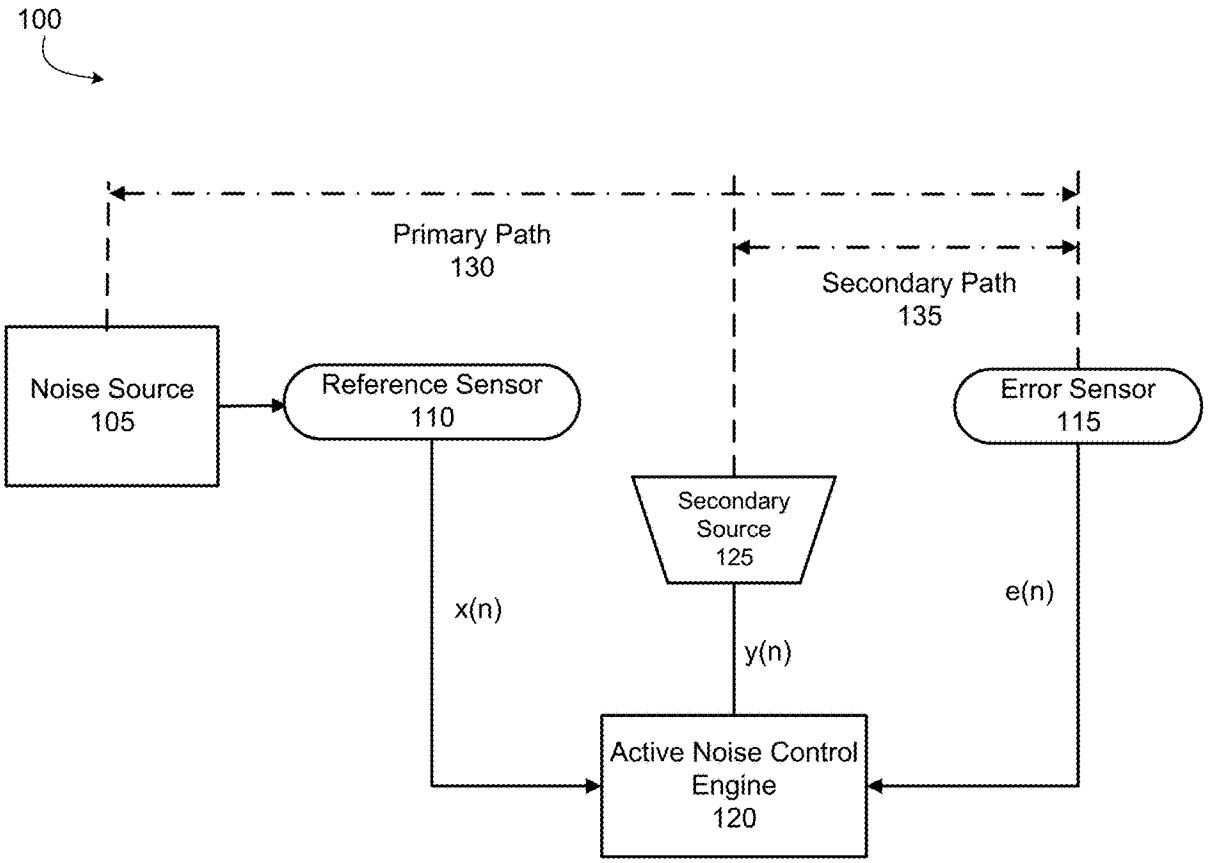
FIG. 1 is a block diagram of an example of an active noise control (ANC) system.

This document describes technology that detects unstable conditions in an active noise control (ANC) system relatively quickly such that the unstable conditions may be mitigated before adversely affecting the performance of the ANC system. For example, when an ANC system is deployed in noise canceling headphones, certain unstable conditions, if not addressed quickly, can cause the headphones to generate a loud noise that is uncomfortable for the user. The technology described herein may allow for detecting an unstable condition using low complexity filters such as an adaptive line enhancer (ALE), and based on quantities computed over a small number of samples of an input signal. This in turn may allow for early detection of unstable conditions, which may then be mitigated before the performance of the ANC system is adversely affected. In some cases, this may enable better performance of the ANC system, for example, by facilitating realization of aggressive compensators that can operate over a wider range of frequencies.

Acoustic noise control systems are used for cancelling or reducing unwanted or unpleasant noise. For example, such noise control systems may be used in personal acoustic devices such as headsets, earphones, etc. to reduce the effect of ambient noise. Unless specified otherwise, the term headphone, as used in this document, includes various types of such personal acoustic devices such as headsets, earphones, earbuds, and hearing aids. Acoustic noise control can also be used in automotive or other transportation systems (e.g., in cars, trucks, buses, aircrafts, boats or other vehicles) to cancel or attenuate unwanted noise produced by, for example, mechanical vibrations or engine harmonics.

In some cases, Active Noise Control (ANC) systems can be used for attenuating or canceling unwanted noise. In some cases, an ANC system can include an electroacoustic or electromechanical system that can be configured to cancel at least some of the unwanted noise (often referred to as primary noise) based on the principle of superposition. This can be done by identifying an amplitude and phase of the primary noise and producing another signal (often referred to as an anti-noise signal) of about equal amplitude and opposite phase. An appropriate anti-noise signal combines with the primary noise such that both are substantially canceled at the location of an error sensor (e.g., canceled to within a specification or acceptable tolerance). In this regard, in the example implementations described herein, "canceling" noise may include reducing the "canceled" noise to a specified level or to within an acceptable tolerance, and does not require complete cancellation of all noise. ANC systems can be used in attenuating a wide range of noise signals, including, for example, broadband noise and/or low-frequency noise that may not be easily attenuated using passive noise control systems. In some cases, ANC systems provide feasible noise control mechanisms in terms of size, weight, volume, and cost.

FIG. 1 shows an example of an active noise control system 100 for canceling a noise produced by a noise source 105. This noise can be referred to as the primary noise. For personal acoustic devices such as noise cancelling headphones or earphones, the primary noise may be ambient noise. For other systems, e.g., an ANC system deployed in an automobile, the primary noise can be a noise generated by the engine of the automobile. The nature of the primary noise may vary from one application to another. For example, for an ANC system deployed in a noise canceling headphone, the primary noise can be broadband noise. In another example, for an ANC system deployed in an automobile, the primary noise can be a narrowband noise such as harmonic noise.

In some implementations, the system 100 includes a reference sensor 110 that detects the noise from the noise source 105 and provides a signal to an ANC engine 120 (e.g., as a digital signal x(n)). The ANC engine 120 produces an anti-noise signal (e.g., as a digital signal y(n)) that is provided to a secondary source 125. The secondary source 125 produces a signal that cancels or reduces the effect of the primary noise. For example, when the primary noise is an acoustic signal, the secondary source 125 can be configured to produce an acoustic anti-noise that cancels or reduces the effect of the acoustic primary noise. Any cancellation error can be detected by an error sensor 115. The error sensor 115 provides a signal (e.g., as a digital signal e(n)) to the ANC engine 120 such that the ANC engine can modify the anti-noise producing process accordingly to reduce or eliminate the error. For example, the ANC engine 120 can include an adaptive filter, the coefficients of which can be adaptively changed based on variations in the primary noise.

The ANC engine 120 can be configured to process the signals detected by the reference sensor 110 and the error sensor 115 to produce a signal that is provided to the secondary source 125. The ANC engine 120 can be of various types. In some implementations, the ANC engine 120 is based on feed-forward control, in which the primary noise is sensed by the reference sensor 110 before the noise reaches a secondary source such as secondary source 125. In some implementations, the ANC engine 120 can be based on feedback control, where the ANC engine 120 cancels the primary noise based on the residual noise detected by the error sensor 115 and without the benefit of a reference sensor 110. In some implementations, both feed-forward and feedback control are used. The ANC engine 120 can be configured to control noise in various frequency bands. In some implementations, the ANC engine 120 can be configured to control broadband noise such as white noise. In some implementations, the ANC engine 120 can be configured to control narrow band noise such as harmonic noise from a vehicle engine.

In some implementations, the ANC engine 120 includes an adaptive digital filter, the coefficients of which can be adjusted based on, for example, the variations in the primary noise. In some implementations, the ANC engine is a digital system, where signals from the reference and error sensors (e.g., electroacoustic or electromechanical transducers) are sampled and processed using processing devices such as digital signal processors (DSP), microcontrollers or microprocessors. Such processing devices can be used to implement adaptive signal processing techniques used by the ANC engine 120.

Figure 2:
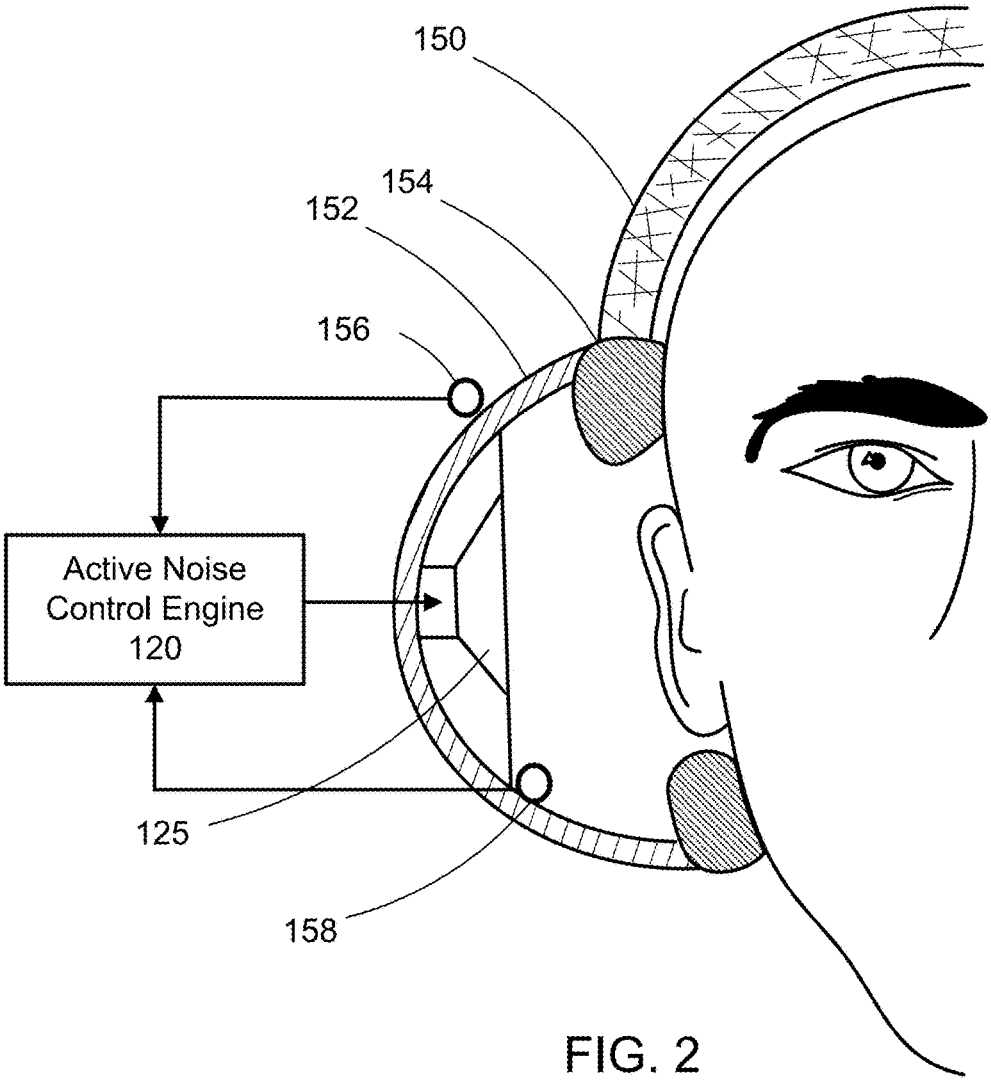
FIG. 2 shows an example of an ANC system deployed in a headphone.

FIG. 2 shows an example of an ANC system deployed in a headphone 150. The headphone 150 includes an ear-cup 152 on each side, which fits on, around or over the ear of a user. The ear-cup 152 may include a layer 154 of soft material (e.g., soft foam) for a comfortable fit over the ear of the user. The ANC system on the headphone 150 includes an external microphone 156 disposed on or near the outside of the ear-cup to detect ambient noise. The external microphone 156 may serve as the reference sensor (e.g., the reference sensor 110 shown in the block diagram of FIG. 1) for the ANC system. The ANC system also includes an internal microphone 158 which may serve as the error sensor (e.g., the error sensor 115 in the bock diagram of FIG. 1). The internal microphone 158 can be deployed proximate (e.g., within a few millimeters) to the user's ear canal and/or the secondary source 125. The secondary source 125 can be the acoustic transducer that radiates audio signals from an audio source device that the headphone 150 is connected to. The external microphone 156, the internal microphone 158, and the secondary source 125 are connected to an active noise control engine 120 as shown in FIG. 2. While FIG. 2 illustrates an example where the ANC system is deployed in an around-ear headphone, the ANC system could also be deployed in other form-factors, including in-ear headphones, on-ear headphones, or off-ear personal acoustic devices (e.g., devices that are designed to not contact a wearer's ears, but may be worn in the vicinity of the wearer's ears on the wearer's head or on body). Referring again to FIG. 1, the acoustic path between the noise source and the error sensor 115 may be referred to as the primary path 130, and the acoustic path between the secondary source 125 and error sensor 115 may be referred to as the secondary path 135. In the example of FIG. 2, the acoustic path between the external microphone 156 and the internal microphone may form a portion of the primary path, and the acoustic path between the secondary source 125 and the internal microphone 158 may form the secondary path. In some implementations, the primary path 130 and/or the secondary path 135 can include additional components such as components of the ANC system or the environment in which the ANC system is deployed. For example, the secondary path can include one or more components of the ANC engine 120, secondary source 125, and/or the error sensor 115 (e.g., the internal microphone 158). In some implementations, the secondary path can include electronic components of the ANC engine 120 and/or the secondary source 125, such as one or more digital filters, amplifiers, digital to analog (D/A) converters, analog to digital (ND) converters, and digital signal processors. In some implementations, the secondary path can also include an electro-acoustic response (e.g., frequency response and/or magnitude response) associated with the secondary source 125, an acoustic path associated with the secondary source 125 and dynamics associated with the error sensor 115.

In some implementations, an ANC system deployed in a headset can also be used to shape a frequency response of the signals passing through the headset. For instance, a feedback controller may be used to change an acoustic experience of having an earbud blocking the ear canal to one where ambient sounds (e.g., the user's own voice) sound more natural to the user. In some implementations, the headphone 150 can include a feature that may be referred to as an "aware mode" or "talk-through." In such a mode, the external microphone 156 can be used to detect external sounds that the user might want to hear, and the active noise control engine 120 can be configured to pass such sounds through, for example, to be reproduced by the secondary source 125. In some cases, the external microphone used for the talk-through feature can be a microphone separate from the microphone 156. In some implementations, signals captured by multiple microphones can be used (e.g., using a beamforming process) to focus, for example, on the user's voice or another source of ambient sound. In some implementations, the active noise control engine 120 can be configured to implement the talk-through feature by allowing signals captured by the microphone 156 to pass to the secondary source 125 (or another acoustic transducer) without substantial signal processing. For example, the ANC engine 120 can be configured to pass a talk-through signal with only a small amount of amplification or a gain substantially equal to unity. In such cases, the talk-through system may be referred to as a "direct talk-through" system. Direct talk-through systems can be configured to use a band-pass filter to restrict the external sounds to voice-band or some other band of interest. In some implementations, the direct talk-through feature may be manually triggered, or automatically triggered by detection of a sound of interest, such as voice or an alarm.

In some implementations, the ANC engine 120 can be configured to process the talk-through signals, for example, to preserve the acoustic naturalness of the signals. This may be referred to as "ambient naturalness," and can be accomplished, for example, through one or more filters disposed within the ANC engine 120. For example, if the ANC engine 120 includes both feedback and feed-forward noise cancellation circuits, either or both cancellation circuits may be modified to process the talk-through signals. As explained in U.S. Pat. No. 8,155,334, the entire content of which is incorporated herein by reference, a feed-forward filter implemented using a digital signal processor can be modified to provide talk-through by not cancelling at least a portion of the ambient noise. Other methods and systems for improving naturalness of talk-through signals are described in U.S. Pat. No. 8,798,283, the entire content of which is incorporated herein by reference.

In implementations where a headphone includes an aware mode, some conditions can lead to the onset of an unstable condition. For example, if the output of the secondary source 125 gets fed back to the external (or feedforward) microphone 156, and the ANC engine 120 passes the signal back to the secondary transducer (as typical in an aware mode), this can lead to a fast-deteriorating unstable condition that results in an objectionable sound emanating from the secondary transducer. This can be demonstrated, for example, by cupping a hand around a headphone to facilitate a feedback path between the secondary source 125 and the external microphone 156. Such a feedback path may be established during the use of the headphone, for example, if the user puts on a headgear (e.g., a head sock or winter hat) over the headphone.

In some implementations, the unstable condition can also occur, for example, due to changes in the transfer function of a secondary path 135 of the ANC system. This can happen, for example, if the acoustic path between the secondary source and the feedback microphone is changed in size or shape. The condition may be demonstrated, for example, by blocking the opening (e.g., using a finger or palm) through which sound emanates out of the headphone. In the case of a headphone having a nozzle with an acoustic passageway that acoustically couples a front cavity of an acoustic transducer to a user's ear canal, this condition may be referred to as a blocked-nozzle condition. This condition can result in practice, for example, during placement/removal of the headphone in the ear. This effect may be particularly observable in smaller headphones (e.g., in-ear earphones) or in-ear hearing aids, where the secondary path can change if the earphone or hearing-aid is moved while being worn. For example, moving an in-ear earphone or hearing aid can cause the volume of air in the corresponding secondary path to change, thereby causing the ANC system to be rendered unstable. In some cases, pressure fluctuations in the ambient air can also cause the ANC system to go unstable. For example, when the door or window of a vehicle (e.g., a bus door) is closed, an accompanying pressure change may cause an ANC system become unstable. Another example of pressure fluctuations that can result in an unstable condition is a significant change in the ambient pressure of air relative to normal atmospheric pressures at sea level.

Unless an unstable condition is quickly detected and addressed, the unstable condition may deteriorate quickly and potentially cause a loud audible feedback to be produced by the secondary source 125, which may be uncomfortable for the wearer. The technology described herein allows for detecting an unstable condition quickly (e.g., by processing a small number of samples, or on a sample-by-sample basis) and taking steps to mitigate the condition so that the unstable condition does not reach a stage where a loud audible feedback is produced. In some implementations, this may be done by processing feedback samples to detect a tonal signature indicative of an unstable condition, and determining a quantity that represents the strength of the tonal signature within the other signals emanating from the secondary source. For example, the strength of the tonal signature may be determined using a "quasi-SNR" quantity where the numerator represents the tonal signature, and the denominator represents the other signals emanating from the secondary source. This document refers to such a quantity as a "quasi-SNR" measure because unlike in a regular SNR, the signal-of-interest in the overall system (e.g., music, talk-through signal, etc.) is represented in the denominator.

Figure 3A:
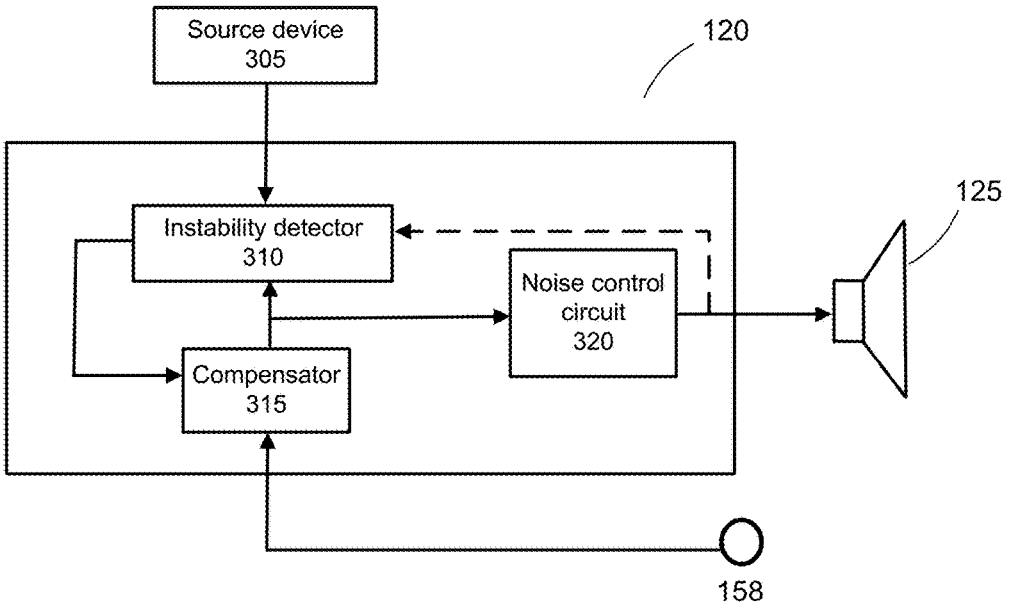
FIGS. 3A and 3B are block diagrams of example ANC systems in accordance with technology described herein.
Figure 3B:
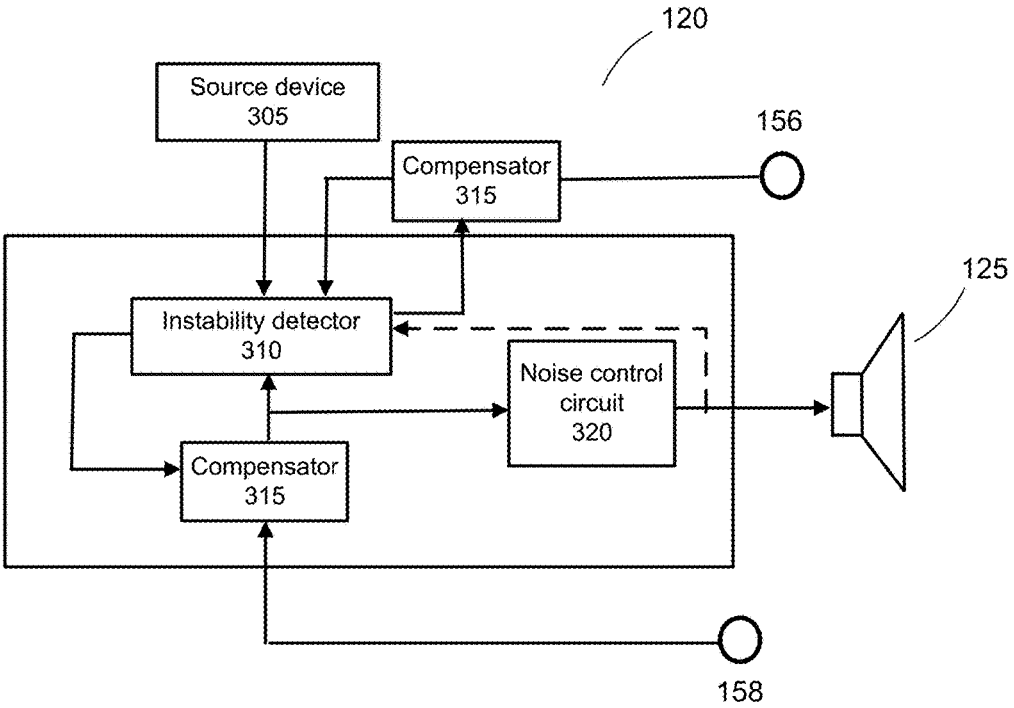

FIGS. 3A and 3B are block diagrams of example configurations of ANC systems that may be used for detecting and mitigating unstable conditions in accordance with technology described herein. Specifically, FIG. 3A represents a configuration where the ANC engine 120 detects and mitigates unstable conditions due to changes in the secondary path (e.g., blocked nozzle conditions), and FIG. 3B represents a configuration where the ANC engine 120 detects and mitigates unstable conditions due to establishment of an acoustic path between the internal microphone 158 and the external microphone 156 (e.g., in an aware mode). The two block diagrams in FIGS. 3A and 3B are intended to illustrate functional differences between the two configurations and do not necessarily represent two separate systems. For example, the ANC engine 120 may receive input from an external microphone 156 but not use it in instability detection.

In some implementations, the ANC engine 120 includes an instability detector 310 that can be configured to detect the presence of an unstable condition. The ANC system 120 also includes one or more compensators 315 that can be adjusted based on the output of the instability detector to mitigate any unstable condition detected by the instability detector 310. The output of the compensator 315 can be provided to a noise control circuit 320 that performs active noise cancellation on signals that are output through one or more acoustic transducers acting as the secondary source 125. In some implementations, a compensator 315 can be disposed between a microphone (e.g., an external microphone 156 or an internal microphone 158) and the instability detector 310. In some implementations, the compensator 315 can be adjusted to compensate for changes to the transfer function of a secondary path of the ANC system that could potentially be causing the instability. This can be done, for example, by a control signal generated by the instability detector 310 based on a feedback signal representing at least a portion of the signal provided to the secondary source 125. The signal paths corresponding to such feedback signals are represented by the dashed lines in FIGS. 3A and 3B.

In some implementations, the instability detector 310 receives samples of signals obtained by the internal microphone 158 and detects the presence or absence of an unstable condition by processing the samples. For example, the instability detector 310 can be configured to detect a tonal signature of any unstable condition within a portion of the signal captured by the internal microphone 158, and calculate a quasi-SNR quantity that represents a relative strength of the tonal signature within a signal of interest associated with the system. This is illustrated using the block diagrams of FIGS. 4A and 4B, which show block diagrams of example configurations of an instability detector. Specifically, FIGS. 4A and 4B show block diagrams corresponding to the configurations of FIGS. 3A and 3B, respectively.

Figure 4A:
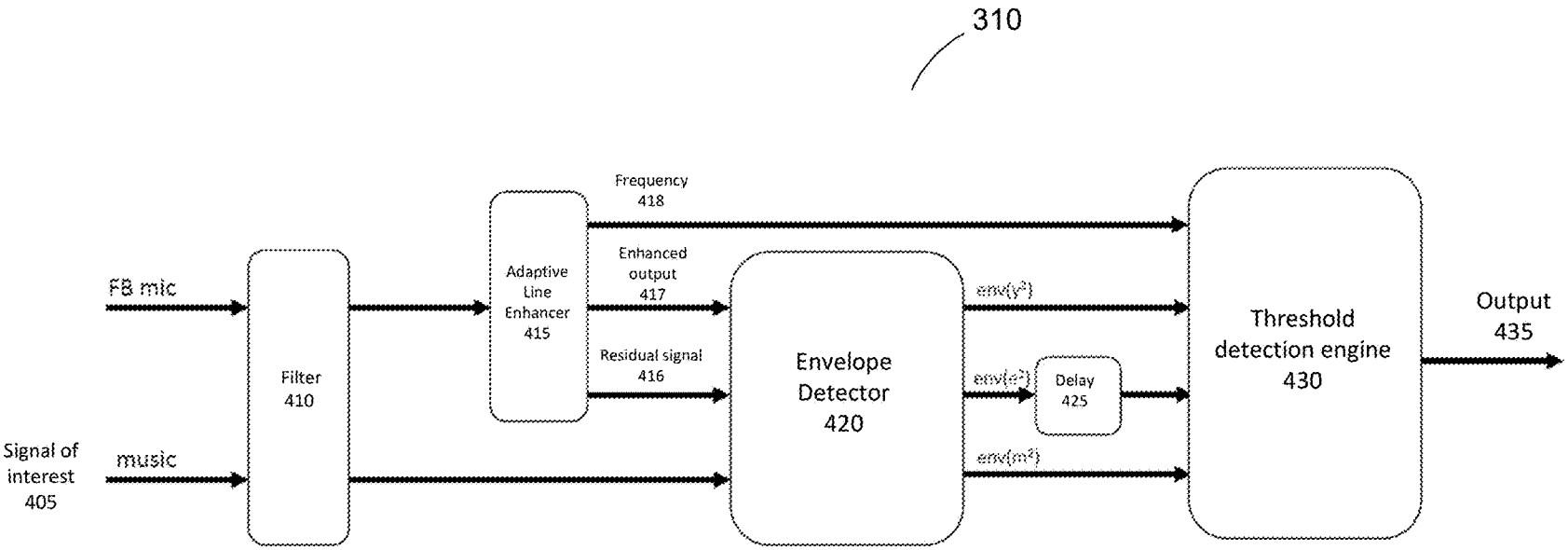
FIGS. 4A and 4B are block diagrams of instability detectors used in the systems of FIGS. 3A and 3B, respectively.
Figure 4B:
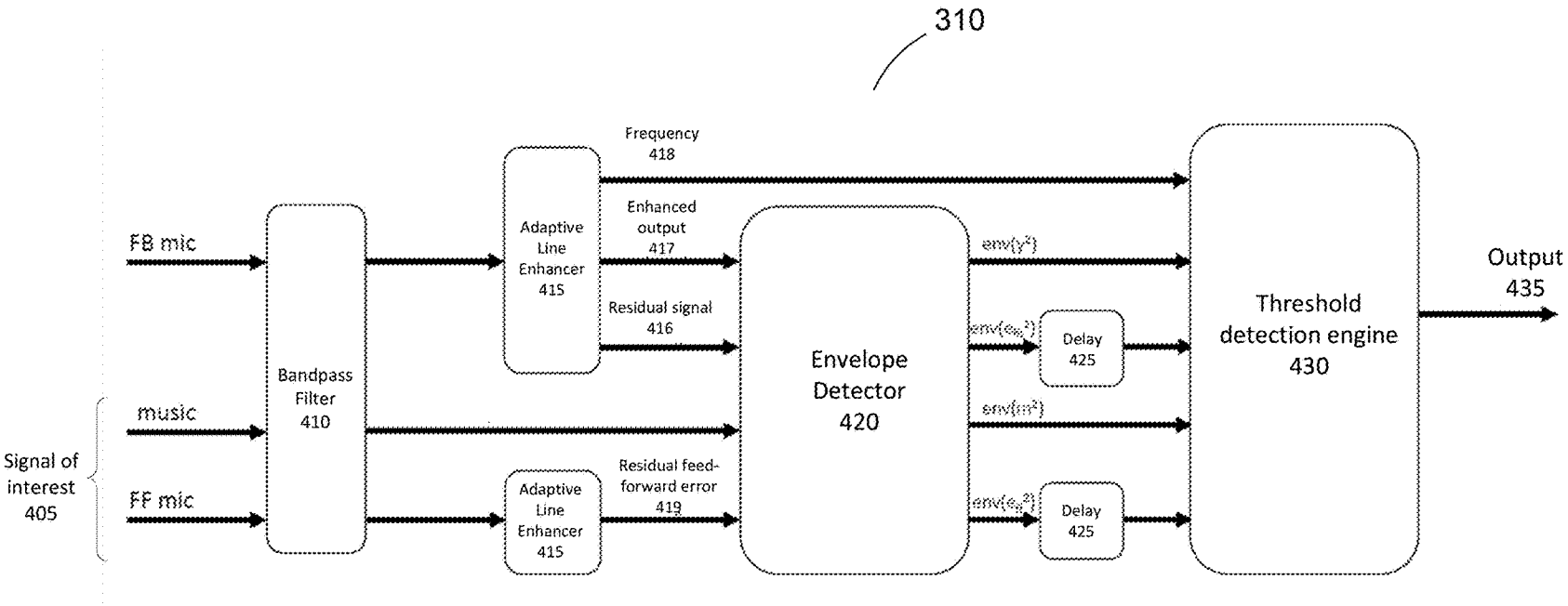

Referring now to FIGS. 4A and 4B, in some implementations, input to the instability detector 310 can be preprocessed using a filter 410. Such a filter 410 can be implemented, for example, as a portion of the instability detector 310 or as a preprocessing module at the front end of the instability detector. In some implementations, the filter 410 may be implemented as a portion of another module such as the compensator 315 shown in FIG. 3. The filter taps for the filter 410 can be configured to remove at least a portion of the input, which includes, for example, a signal from the internal microphone 158 (also referred to as the feedback microphone or "FB mic") and one or more signals of interest 405. In some implementations, the filter 410 can be a bandpass filter, the passband of which may include a range of frequencies over which the tonal signature of an instability may be expected. For example, if it is known that unstable conditions in a given system are manifested as narrow-band tonal signatures within a 1-10 KHz range, the passband of the filter 410 may be configured to include the 1-10 KHz frequency range. Other broader or narrower ranges may also be used, depending on the nature of the unstable conditions in the corresponding systems. For example, the filter can be configured to have a passband that spans the frequency range 1.5 KHz-5 KHz or 500 Hz-2 KHz. In some cases, for example when a headphone is damaged, instabilities can occur at frequency ranges not typically associated with instabilities. For example, when an earbud is physically damaged, instabilities can occur around 800 Hz-1 KHz, which may not be a "normal" range where instabilities are expected in an undamaged headphone. In some implementations, the filter can be configured to have a passband that encompasses such frequencies.

In some implementations, the signal of interest 405 includes a signal that is intended to be output by the secondary source 125. This can include, for example, a signal received from a source device 305 (as shown in FIGS. 3A and 3B) such as a smartphone, tablet computer, smartwatch, or another media player. In some implementations, the source device 305 can be a repeater such as a remote controller that is configured to route audio signals from a corresponding media player. In FIGS. 4A and 4B, the signal from the source device 305 is denoted as "music" but in general can include any signal provided by the corresponding source device 305. In some implementations, the signal of interest 405 can also include a signal captured by an external microphone 156 (e.g., when the headphone is operating in an aware mode). This is depicted in FIG. 4B, where the signal from the external microphone is denoted as "FF mic." In some implementations, the signal of interest 405 can include fewer or more signals. For example, some configurations may not include a source device 305, and the signal of interest 405 may include only the signal captured by a microphone such as the external microphone 156. This can happen, for example, when the ANC engine 120 is deployed in a hearing aid, or in situations where the source device 305 is turned off (e.g., manually, or upon detection of a talk-through signal).

Figure 5:
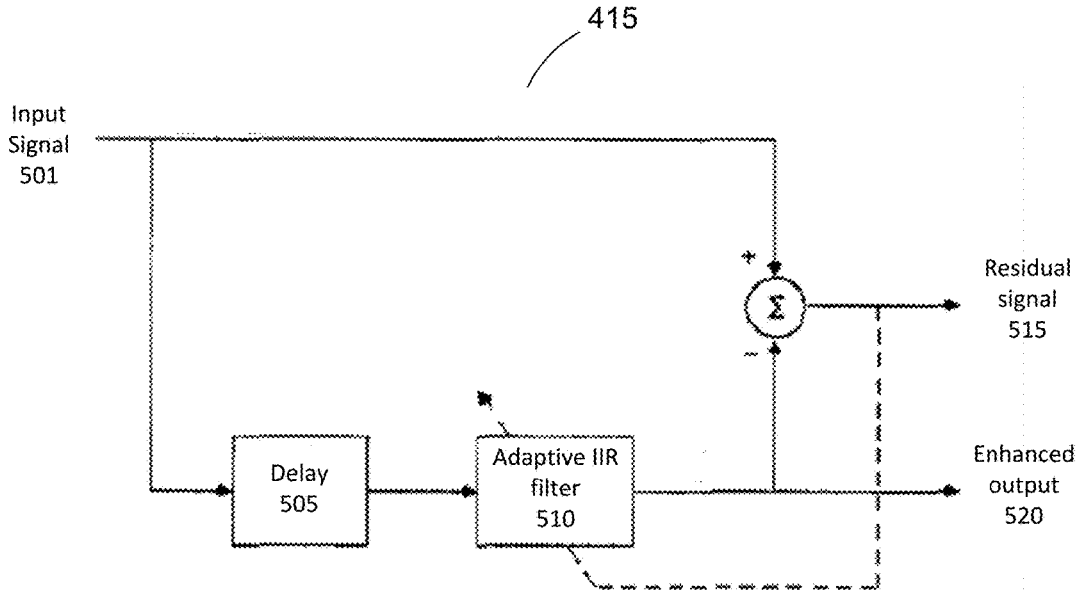
FIG. 5 is a block diagram of an example of an adaptive line enhancer.

As shown in FIGS. 4A and 4B, the instability detector 310 can include an adaptive line enhancer (ALE) 415 that can be configured to output one or more quantities usable for instability detection. For example, the ALE 415 can be implemented as an adaptive infinite impulse response (IIR) filter that can be configured to output one or more of a residual signal 416, an enhanced output 417, and a frequency (or frequency range) 418 associated with the enhanced output 417. FIG. 5 shows a block diagram of an example of such an ALE 415, where the ALE is implemented using a single tap IIR filter 510 and a delay element 505. The ALE depicted in FIG. 5 processes an input signal 501 to provide the residual signal 416 and the enhanced output 417. In some implementations, where the input signal 501 is a signal from a microphone, and includes a signal representative of an unstable condition, the enhanced output 417 can include a tonal signature corresponding to the unstable condition. In some implementations, the tonal signature may be a narrowband signal spanning a small frequency range. In some implementations, the ALE 415 can also be configured to detect a frequency (or frequencies, or a range of frequencies) associated with the enhanced output 417 and generate a signal 418 indicative of the frequency or frequencies. Using a low complexity filter such as a single tap IIR ALE filter may allow for sample by sample processing of the input signal, and quick but accurate determination of any unstable condition. Examples of such filters are described in the article—Hush et. al, "An Adaptive IIR Structure for Sinusoidal Enhancement, Frequency Estimation, and Detection," IEEE Transactions of Acoustics, Speech, and Signal Processing, Vol. ASSP-34, No. 6, December 1986—the entire content of which is incorporated herein by reference.

Referring to FIG. 4B, if the signal of interest 405 includes a signal from the external microphone 156 ("FF Mic"), the instability detector 310 can include a second ALE 415 for processing the signal from the external microphone 156. In some implementations, the ALE 415 used for processing the signal from the internal microphone 158 can also be used for processing the signal from the external microphone 156. The residual error provided by the ALE processing the signal from the external microphone 156 can be referred to as the residual feed-forward error 419.

In some implementations, the instability detector 310 is configured to process the outputs of the one or more ALEs 415 and the signal of interest to generate the quasi-SNR quantity usable for detecting the presence of an unstable condition. This can be done, for example, by computing the relative strength of a tonal signature detected in the ALE output corresponding to the internal microphone to that of the combination of the other signals. In some implementations, the relative strength can be determined as a ratio of (i) a first quantity indicative of the energy of the tonal signature, to (ii) a second quantity indicative of the energy of a combination of the residual error and the portion of the signal-of-interest. The presence of an unstable condition can then be detected by comparing the ratio against a threshold. In some implementations, the instability detection may also be conditioned on the detected frequency 418 being within a predefined frequency range. In some implementations, an IIR filter used in a feedforward system can be slaved to the detected center frequency of an ALE for a feedback microphone (e.g., the internal microphone 158), thereby requiring a single ALE 415 in the instability detector 310.

For the configuration depicted in FIG. 3A (with the corresponding instability detector shown in FIG. 4A), the instability detector 310 can be configured to detect the presence of unstable condition if the detected frequency 418 is within a predetermined range (e.g., between 1.5 KHz and 5 KHz) and if the following condition is satisfied:

$$\mathrm{dB}\left[\frac{env(y^2(t))}{k_2 + \mathrm{delay}(env(e^2(t))) + env(m^2(t))}\right] > k_1 \tag{1}$$

wherein y(t) denotes the enhanced output 417, e(t) denotes the residual signal 416, and m(t) denotes the signal of interest. The operator dB(.) denotes conversion to decibel, the operator env(.) denotes envelope detection, and the operator delay(.) denotes a shift that may be needed for alignment of the various quantities. The comparison may be performed, for example, by a threshold detection engine 430, and the envelope detection may be performed, for example, by an envelope detector 420, both of which modules are depicted in FIGS. 4A and 4B. The term $k_1$ denotes a threshold that may be set based on a tradeoff between speed and accuracy. For example, if $k_1$ is set to a low value, any unstable condition may be detected faster, but with higher chances of false positives (i.e., detecting an unstable condition when in fact one is not present). On the other hand, setting $k_1$ to a relatively higher value may reduce false positives at the cost of requiring relatively more time for detecting an unstable condition. The term $k_2$ denotes a shift introduced by a delay 425 (as shown in FIGS. 4A and 4B) to align the various inputs provided to the threshold detection engine 430. The delay may be determined experimentally, and in some cases, may not be needed.

For the configuration depicted in FIG. 3B (with the corresponding instability detector shown in FIG. 4B), the instability detector 310 can be configured to detect the presence of unstable condition if the detected frequency 418 is within a predetermined range (e.g., between 1.5 KHz and 5 KHz) and if the following condition is satisfied:

$$\mathrm{dB}\left[\frac{env(y^2(t))}{k_2 + \mathrm{delay}(env(e_{ff}^2(t))) + \mathrm{delay}(env(e^2(t))) + env(m^2(t))}\right] > k_1 \tag{2}$$

wherein the $e_{ff}(t)$ denotes the residual feed-forward error 419. The equation (2) can be used, for example, in detecting an unstable condition for a headphone operating in the aware mode because the denominator includes a quantity derived from the signal captured by the external microphone 156.

Figure 6:
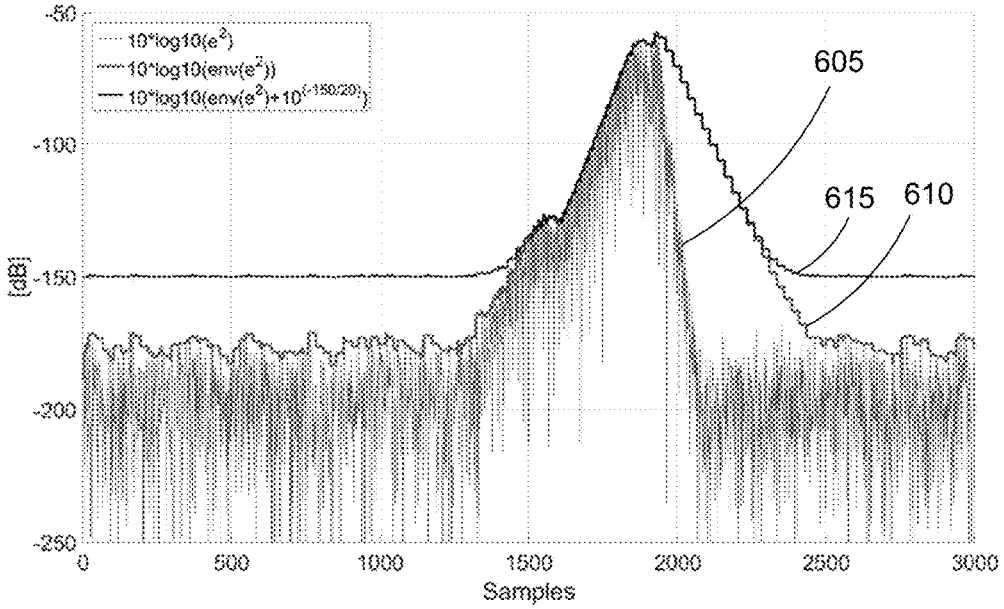
FIG. 6 is a plot showing various parameters associated with the instability detectors described herein.

Referring again to FIGS. 4A and 4B, the envelope detector 420 can be configured to perform the envelope detection process by keeping track of the highest valued sample for a preset number of samples. A counter tracks the number of samples over which the highest value is tracked, and is reset if a higher value is detected before expiry of the counter. If the counter expires without the arrival of a higher valued sample, the stored highest value (or a fraction thereof) can be output and the counter reset to track the highest value for the preset number of subsequent samples. FIG. 6 is a plot of various parameters (in dB) associated with the instability detectors described herein. In this example, the trace 605 represents the squared raw error, the trace 610 represents the envelope of the squared raw error, and the trace 615 represents the denominator of the ratio in equation (1) in the absence of a signal of interest m(t). In this example, $k_2$ was set at $10^{(-150/20)}$.

Figure 7A:
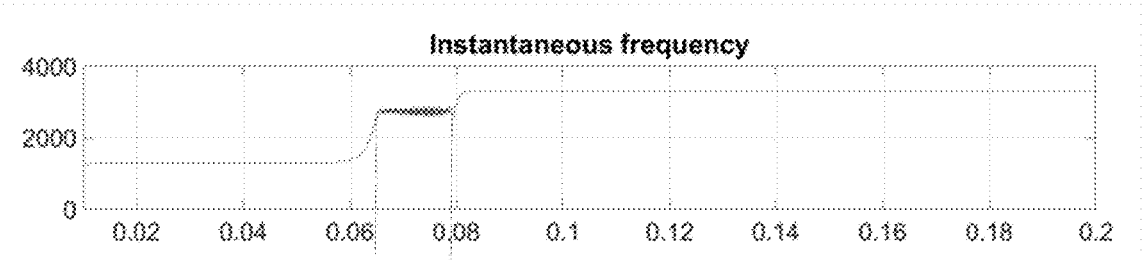
FIGS. 7A-7C are plots illustrating results of using an instability detector in an ANC system in accordance with technology described herein.
Figure 7B:
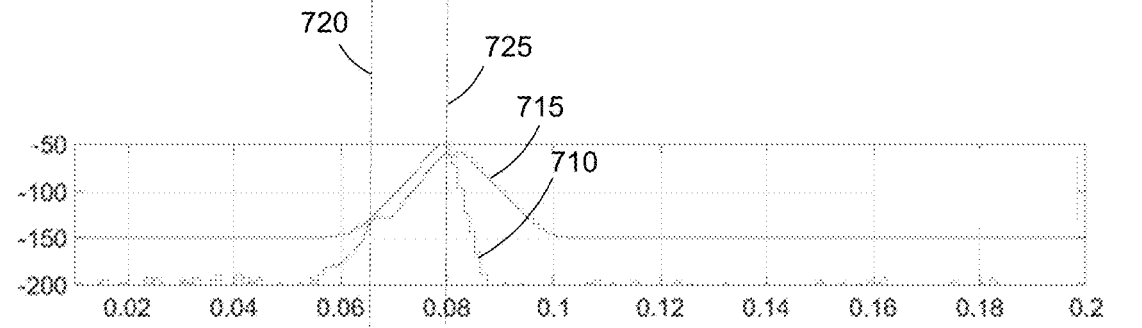
Figure 7C:
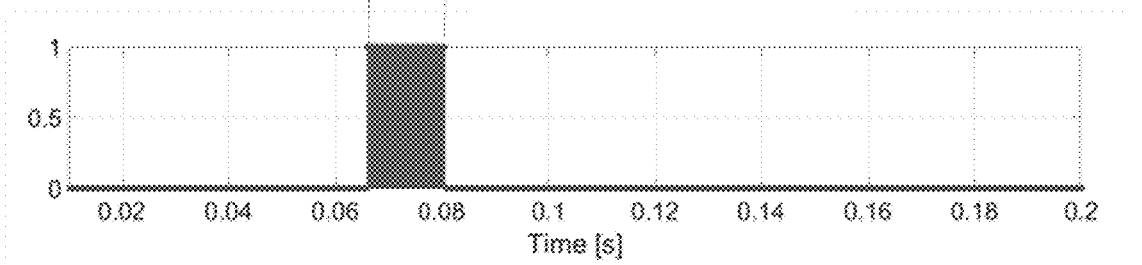

FIGS. 7A-7C are plots illustrating instability detection in the instability detector 310 represented in FIG. 4A. Specifically, FIG. 7A shows the instantaneous frequency 418 as detected by an ALE 415. FIG. 7B shows traces for two separate quantities. The trace 710 represents the envelope of the squared enhanced output of the ALE 415, and the trace 715 represents the envelope of the squared error of the ALE 415 generated in a fashion similar to that used for generating the trace 615 in FIG. 6. In this example, the condition on the instantaneous frequency and the conditions represented by equation (1) are simultaneously satisfied between the time points represented by the two dashed lines 720 and 725. Accordingly, in FIG. 7C, which shows the output 435 of the instability detector 310, the output is maintained at logic high (or "1") between the two time points.

Referring again to FIGS. 3A and 3B, an output of the instability detector can be used to adjust a compensator 315 to mitigate any unstable condition. In some implementations, the compensator 315 (including one or more filters, which may have adaptive or adjustable filter taps) can be disposed in the path of the signal from a microphone (e.g., the internal microphone 158), and a logic high output of the instability detector can be used to adjust a filter that processes the signal received from the microphone. For example, if the output of the instability detector 310 indicates the presence of an unstable condition, the gain of a filter processing the signal from the microphone can be reduced, which in turn may prevent the unstable condition from deteriorating further.

In some implementations, the frequency response of the filter may also be adjusted, for example, to suppress the frequency or frequencies at which the unstable condition is detected. In some implementations, the compensator 315 can be configured to adjust the frequency response of the filter to compensate for changes to the transfer function of a secondary path of the ANC system that could potentially be causing the instability. Checking for changes to the transfer function between the secondary source and the error microphone can include, for example, detecting an instantaneous transfer function phase response corresponding to the instantaneous frequency 418 detected by the ALE 415. If the instantaneous phase response corresponds to a change within a given frequency range where an instability is expected, the feedback gain corresponding to that range may be adjusted to account for the instability. In some implementations, the instantaneous magnitude response of the transfer function may also be used, either as a standalone measure, or to corroborate a finding of a change in the instantaneous phase response. In some implementations, the instantaneous, single-frequency transfer function can be calculated using a demodulation process applied to signals from the source device 305 and the microphones. This can include low-pass filtering the signals using a filter having, for example, a 500 Hz roll-off frequency. In some cases, this can result in the calculated response being smooth for up to several-kHz, but still allow the compensator 315 to respond to rapid changes.

While FIG. 4B shows a compensator 315 for processing signals from each of the external microphone 156 and the internal microphone 158, other configurations are also possible. For example, the ANC engine 120 can include a compensator for only the internal microphone 158, or only the external microphone 156.

The compensator 315 can also be configured to process the signals captured by the microphones independently of the signal received from the instability detector. For example, a compensator 315 processing the signal captured by the external microphone 156 can be configured to amplify the frequencies that are suppressed when the ear is covered or blocked by the headphone, and/or to suppress the frequencies that are amplified when the ear is covered or blocked by the headphone.

In some cases, when a compensator mitigates an unstable condition at a particular frequency, the changes to the filter may cause instability at another frequency. Therefore, in the absence of the technology described herein, the range of frequencies over which unstable conditions are mitigated by the compensator may be limited. In some cases, this may result in a degraded performance for the ANC systems. For example, the resonance frequency for a particular headphone may be shifted to a lower frequency if a blocked-nozzle condition develops (e.g., from around 5 KHz to around 3 KHz). In such cases, it may be desirable for the compensator to operate over a larger frequency range. Because the technology described herein may facilitate detecting unstable conditions quickly (e.g., based on a small number of samples) and accurately, the technology can be leveraged to implement aggressive compensators that mitigate unstable conditions over a wide range of frequencies. In some implementations, information from the corresponding headphones for the two ears can be processed to reduce chances of false positives. For example, if the same (or substantially similar) stimulus is detected by each headphone, a determination may be made that the stimulus originates at an external source and is not due to a feedforward instability. This in turn may reduce the likelihood of false positives in detecting feedforward instability.

Figure 8:
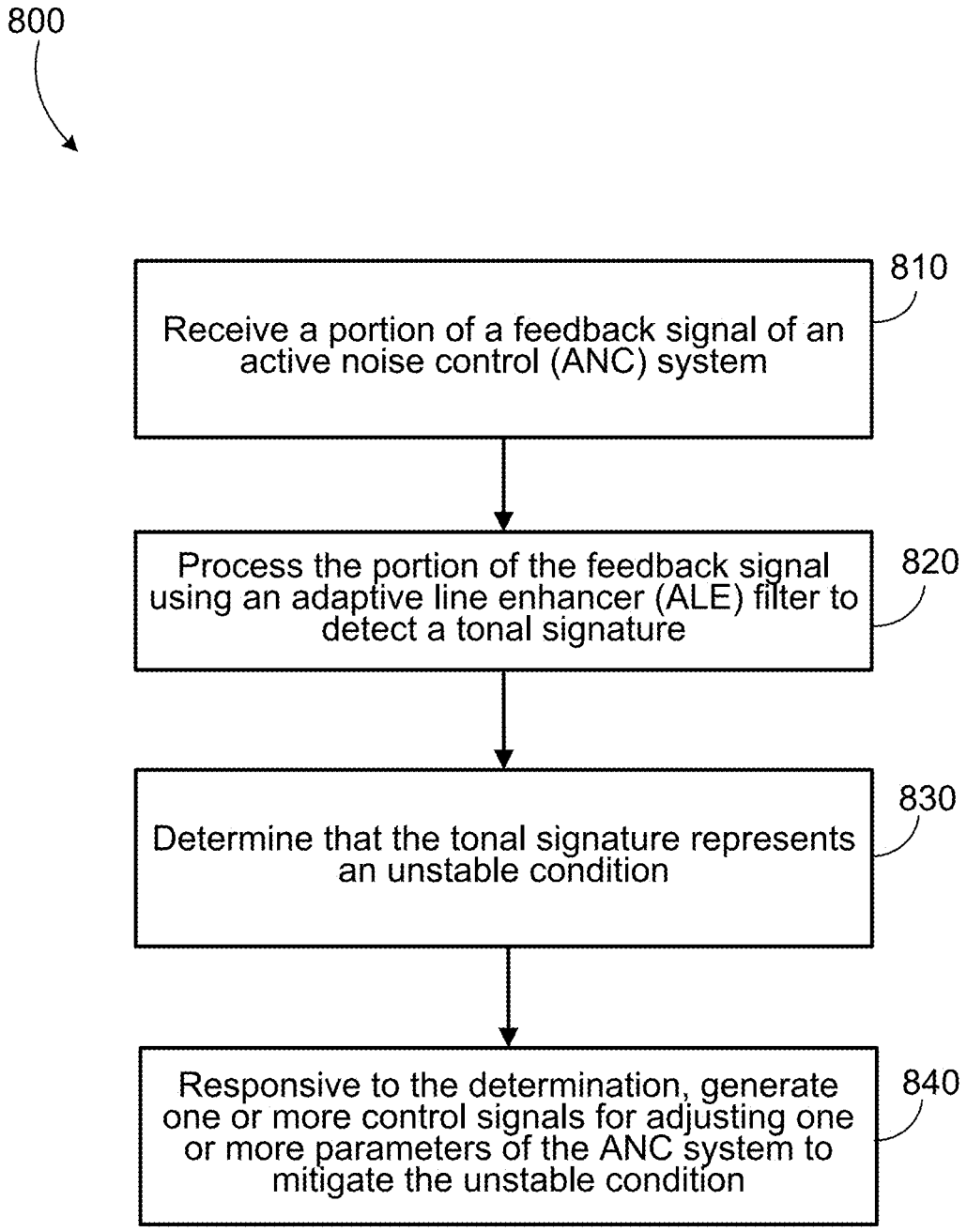
FIG. 8 is a flowchart of an example process of detecting and mitigating an unstable condition in an ANC system.

FIG. 8 shows a flowchart for an example process 800 for detecting an unstable condition in an ANC system, and generating one or more control signals to mitigate the unstable condition. In some implementations, at least a portion of the process is executed at an adaptive engine (e.g., the ANC engine 120, as described above). Example operations of the process 800 include receiving a portion of a feedback signal of an ANC system (810). The feedback signal can be obtained, for example, using an error sensor of the ANC system. In some implementations, where the ANC system is associated with a headphone, the error sensor can include an internal microphone (e.g., the internal microphone 158 described above) that captures audio signals generated by the secondary source of the ANC system.

Operations of the process 800 also include processing the portion of the feedback signal using an ALE filter (820) to detect a tonal signature. In some implementations, the feedback signal may be preprocessed, for example, using a bandpass filter, to generate the portion of the feedback processed by the ALE filter. In some implementations, the ALE filter is implemented as a single tap adaptive IIR filter (or another low-order filter). For example, the ALE filter can be substantially similar to the filter depicted in FIG. 5.

Operations of the process 800 can further include determining that the tonal signature represents an unstable condition (830). For example, the tonal signature representing an unstable condition can be a narrowband signal that lies within a particular frequency range. Therefore, a tonal signature may be determined to represent an unstable condition only if the tonal signature lies in the particular frequency range, and the relative strength of the tonal signature in the overall signal generated by the secondary source is above a threshold. In some implementations, the particular frequency range can be substantially between 1.5 KHz-5 KHz, or 500 Hz-2 KHz. In some implementations, the determination may be done by one or more processing devices (e.g., one or more processing devices of a threshold detection engine 430) disposed within the ANC system. For example, the determination can include computing a quantity (e.g., a quasi-SNR quantity, as described above) indicative of a relative strength of the tonal signature in an output of an acoustic transducer of the ANC system, and determining that the tonal signature represents an unstable condition if the quantity satisfies a threshold condition. In some implementations, the quantity can be computed based on a measure of residual error from the ALE filter and a portion of a signal-of-interest to be output by the acoustic transducer. For example, the quantity may be computed as a ratio of (i) a first quantity indicative of the energy of the tonal signature, to (ii) a second quantity indicative of the energy of a combination of the residual error and the portion of the signal-of-interest. In some implementations, where the ANC system is deployed in a headphone operating in an aware mode, the second quantity can include a component indicative of the energy of a portion of a signal captured by a feedforward microphone (e.g., an external microphone 156) of the ANC system.

Operations of the process 800 can also include generating one or more control signals for adjusting one or more parameters of the ANC system (840). This can be done responsive to determining that the tonal signature represents an unstable condition, and the one or more control signals can be configured to mitigate the unstable condition. In some implementations, the one or more parameters can include a gain or frequency response associated with a filter applied to a feedback microphone (e.g., the internal microphone 158) of the ANC system, and/or a gain or frequency response associated with a filter applied to a feedforward microphone (e.g., the external microphone 156) of the ANC system. In some implementations, the one or more parameters of the ANC system can be adjusted based on a severity of the instability. For example, a high count of quasi-SNR per sample can prompt a large reduction of the feedforward and/or feedback gains. On the other hand, if several instabilities are detected over a period of time, the feedforward and/or feedback gains can be reduced by a fixed amount until the headphone is power-cycled.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). In some implementations, at least a portion of the functions may also be executed on a floating point or fixed point digital signal processor (DSP) such as the Super Harvard Architecture Single-Chip Computer (SHARC) developed by Analog Devices Inc, or an Advanced RISC Machine (ARM) processor.

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Other embodiments and applications not specifically described herein are also within the scope of the following claims. For example, the level of control on the instability mitigation can be tailored based on various parameters such as probability of detection, and target false positive and/or false negative rates. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. A computer-implemented method comprising:

receiving a portion of a feedback signal of an active noise control (ANC) system;

processing the portion of the feedback signal using an adaptive line enhancer (ALE) filter to detect a tonal signature;

computing, by one or more processing devices, a quantity representing a ratio of (i) a first quantity indicative of an energy of the tonal signature, to (ii) a second quantity indicative of an energy of a combination of a residual error received from the ALE filter, and a signal-of-interest associated with an acoustic transducer;

determining, based on the quantity, by the one or more processing devices, that the tonal signature represents an unstable condition; and responsive to determining that the tonal signature represents an unstable condition, generating one or more control signals for adjusting one or more parameters of the ANC system, to mitigate the unstable condition.

2. The method of claim 1, wherein the feedback signal is obtained using an error sensor of the ANC system.

3. The method of claim 1, further comprising:

processing the feedback signal by a digital bandpass filter to generate the portion of the feedback signal processed by the ALE filter.

4. The method of claim 1, wherein the ALE filter is implemented as a single-tap infinite impulse response (IIR) filter.

5. The method of claim 1, wherein determining that the tonal signature represents an unstable condition comprises:

determining that the tonal signature includes components within a predetermined frequency range.

6. The method of claim 5, wherein the predetermined frequency range is substantially between 1.5 KHz and 5 KHz.

7. The method of claim 5, wherein the predetermined frequency range is substantially between 500 Hz and 2 KHz.

8. The method of claim 5, further comprising:

detecting a phase response of a secondary path transfer function of the ANC system, the phase response corresponding to the predetermined frequency range; and determining that the tonal signature represents the unstable condition based also on the phase response.

9. The method of claim 8, further comprising:

detecting a magnitude response of the secondary path transfer function, the magnitude response corresponding to the predetermined frequency range; and determining that the tonal signature represents the unstable condition based also on the magnitude response.

10. The method of claim 5, further comprising:

detecting a magnitude response of a secondary path transfer function of the ANC system, the magnitude response corresponding to the predetermined frequency range; and determining that the tonal signature represents the unstable condition based also on the magnitude response.

11. The method of claim 1, further comprising:

determining that the tonal signature represents an unstable condition based on the quantity satisfying a threshold condition.

12. The method of claim 1, wherein the second quantity is indicative of the energy of a portion of a signal captured by a feedforward microphone of the ANC system.

13. The method of claim 1, wherein the one or more parameters being adjusted to mitigate the unstable condition comprise at least one of: a gain associated with a filter applied to a feedback microphone of the ANC system, and a gain associated with a filter applied to a feedforward microphone of the ANC system.

14. The method of claim 1, wherein the ANC system is deployed in a noise-reducing headphone.

15. The method of claim 1, wherein the one or more control signals are configured to adjust one or more coefficients of an adaptive filter of the ANC system to compensate for changes to a transfer function of a secondary path of the ANC system.

16. An active noise control (ANC) system comprising:

an error sensor configured to provide a feedback signal; and an instability detector comprising:

an adaptive line enhancer (ALE) filter configured to process at least a portion of the feedback signal to detect a tonal signature, and a detection engine comprising one or more processing devices, the detection engine configured to:

compute a quantity as a ratio of (i) a first quantity indicative of the energy of the tonal signature, to (ii) a second quantity indicative of the energy of a combination of a residual error received from the ALE filter, and a signal-of-interest associated with an acoustic transducer;

determine, based on the quantity, that the tonal signature represents an unstable condition, and responsive to determining that the tonal signature represents an unstable condition, generate one or more control signals for adjusting one or more parameters of the ANC system, to mitigate the unstable condition.

17. The system of claim 16, further comprising a digital bandpass filter that processes the feedback signal to generate the portion of the feedback signal processed by the ALE filter.

18. The system of claim 16, wherein the detection engine is configured to:

determine that the tonal signature includes components within a predetermined frequency range, and responsive to determining that the tonal signature includes components within the predetermined frequency range, determining that the tonal signature represents the unstable condition.

19. The system of claim 18, wherein the detection engine is further configured to:

detect a phase response of a secondary path transfer function of the ANC system, the phase response corresponding to the predetermined frequency range; and determine that the tonal signature represents the unstable condition based also on the phase response.

20. The system of claim 19, wherein the detection engine further configured to:

detect a magnitude response of the secondary path transfer function, the magnitude response corresponding to the predetermined frequency range; and determining that the tonal signature represents the unstable condition based also on the magnitude response.

21. The system of claim 18, wherein the detection engine is further configured to:

detect a magnitude response of a secondary path transfer function of the ANC system, the magnitude response corresponding to the predetermined frequency range; and determine that the tonal signature represents the unstable condition based also on the magnitude response.

22. The system of claim 16, wherein the detection engine is configured to:

determine that the tonal signature represents an unstable condition based on the quantity satisfying a threshold condition.

23. The system of claim 16, wherein the second quantity is indicative of the energy of a portion of a signal captured by a feedforward microphone of the ANC system.

24. A machine-readable storage device having encoded thereon computer readable instructions for causing one or more processors to perform operations comprising:

receiving a portion of a feedback signal of an active noise control (ANC) system;

processing the portion of the feedback signal using an adaptive line enhancer (ALE) filter to detect a tonal signature;

computing a quantity as a ratio of (i) a first quantity indicative of the energy of the tonal signature, to (ii) a second quantity indicative of an energy of a combination of the residual error received from the ALE filter, and a signal-of-interest associated with an acoustic transducer;

determining, based on the quantity, that the tonal signature represents an unstable condition; and responsive to determining that the tonal signature represents an unstable condition, generating one or more control signals for adjusting one or more parameters of the ANC system, to mitigate the unstable condition.

* * * * *